United States Patent [19]

Hengle et al.

[11] Patent Number: 4,603,491

[45] Date of Patent: Aug. 5, 1986

[54] REVERSIBLE CROSS FLOW DRYING OR CURING OVEN

[75] Inventors: Robert E. Hengle; William F. Granfors, both of Cleveland, Ohio

[73] Assignee: FECO Engineered Systems, Inc., Cleveland, Ohio

[21] Appl. No.: 678,969

[22] Filed: Dec. 6, 1984

Related U.S. Application Data

[63] Continuation of Ser. No. 491,716, May 5, 1983, abandoned.

[51] Int. Cl.[4] ..... F26B 9/02

[52] U.S. Cl. ..... 34/191; 34/225

[58] Field of Search ..... 34/191, 225, 233

[56] References Cited

U.S. PATENT DOCUMENTS 1,892,319 12/1932 Roth ..... 34/191

4,039,278 8/1977 Denholm ..... 34/225

4,250,917 2/1981 Jespersen et al. ..... 34/191

*Primary Examiner*—Larry I. Schwartz

*Attorney, Agent, or Firm*—Patrick J. Walsh

[57] ABSTRACT

Disclosed is a reversible cross flow drying or curing oven including first and second ducts on opposite sides of the heated oven chamber. A fan forces heated air through a main supply passage into one or the other of the first and second ducts for transmission into the oven chamber. The air in the oven chamber is returned to a main return passage through the other of the first and second ducts thereby establishing a cross flow of heated air in the oven chamber from one duct to the opposite duct. The main return passage communicates with the main supply passage for recirculation of the heated oven air. Flow control devices are provided in the supply and return passage to alternate the direction of the flow of air across the oven chamber between the ducts to provide for even drying or curing of the articles in the oven chamber.

4 Claims, 5 Drawing Figures

REVERSIBLE CROSS FLOW DRYING OR CURING OVEN

This is a continuation of application Ser. No. 491,716 filed May 5, 1983, now abandoned.

BACKGROUND OF THE INVENTION

The present invention relates to an oven for drying or curing articles and particularly relates to a reversible, convection air, cross flow drying or curing oven. More particularly, the present invention relates to a drying or curing oven providing for manual or automatic reversal of cross flow convection air currents within the oven at periodic intervals to obtain uniform drying or curing characteristics substantially throughout the entirety of the oven.

In batch type ovens, workpieces are frequently placed on carts and disposed in the work zone or heat chamber of the oven for drying or curing. Heated air is then supplied to the oven chamber through various ductwork and the workpieces are dried or cured over time. The flow pattern of the convection air current thus obtains a uniformity with time within the oven chamber. A uniform air flow pattern over a substantial period of time, however, creates temperature gradients within the oven chamber. For example, in certain ovens, the ductwork is arranged to flow heated air from one side of the oven to the opposite side or vertically between the top and bottom of the oven. The incoming air on the supply side is thus hotter than the outgoing air on the return side. This causes the workpieces adjacent the incoming supply of hot air to dry or cure at a rate faster than the workpieces located adjacent the relatively cooler, through heated, air near the return side of the oven. Thus, the drying or curing characteristics of the workpieces vary dependent upon their location within the oven because a different temperature is applied thereto at each location.

This variance in temperature within the oven chamber is particularly critical in drying or curing flat sheets, for example, capacitor components which may vary in size from 8½ inches by 11 inches to 4 feet by 8 feet. Flat sheets will often warp, crack or otherwise distort when hot air at different temperatures is applied over the entirety of the surface of the sheets. Moreover, it will be appreciated from the foregoing that the optimum over residence time for proper drying or curing of workpieces in batch type ovens is not dependent on the workpiece which first dries or cures. Rather, if all the workpieces are to be dried or cured, the residency time for all workpieces within the oven is dependent on the workpiece which last dries or cures. Thus, economy of oven operation is sacrificed in those batch type ovens where temperature gradients exist if all workpieces are to be entirely dried or cured over the proper period of time. Also, economy of oven operation is affected by the temperature necessary to dry or cure the workpieces. For example, in batch type ovens, the temperature of the incoming air is usually higher than necessary in order that the workpieces closest to the return will be dried or cured at the designed temperature. Thus, because of the existence of temperature gradients in batch ovens, heated air must be supplied at non-optimum; e.g., higher, temperatures. The operation of the oven therefore requires substantially greater energy input than would be necessary if uniform temperatures could be maintained throughout the oven chamber. Accordingly, there has arisen a need for a new and improved drying or curing oven of the convection air current type which minimizes or eliminates the foregoing and other problems associated with prior convection air current drying or curing ovens and provides a heated air flow pattern affording substantially uniform heating of the workpieces over the duration of their time within the oven.

SUMMARY OF THE PRESENT INVENTION

Accordingly, it is a primary object of the present invention to provide a novel and improved reversible cross flow oven for uniformly and evenly drying or curing workpieces within the oven.

It is another object of the present invention to provide a novel and improved reversible cross flow oven for drying or curing workpieces within the oven chamber wherein the workpieces are substantially uniformly heated over the duration of their residency within the oven chamber.

It is still another object of the present invention to provide a novel and improved reversible cross flow oven for drying or curing workpieces which minimizes or eliminates the tendency of workpieces to crack, warp other otherwise distort upon application of heat to the workpieces within the oven chamber.

It is a related object of the present invention to provide a novel and improved reversible cross flow oven of the batch type for drying or curing workpieces in which the oven is controlled to match the heated air currents to the particular drying or curing process; e.g., to achieve a substantially precise and like drying or curing temperature for each workpiece within the oven regardless of its orientation and location within the oven chamber.

To achieve the foregoing and other objects and advantages of the present invention and in accordance with the purposes thereof, as embodied and broadly described herein, there is provided a reversible cross flow drying or curing oven including an oven housing having opposed side walls defining a drying or curing chamber therebetween for receiving articles to be dried or cured, first and second ducts disposed along the respective opposite side walls of the housing and having openings for transmitting air into and out of the oven chamber, means for supplying heated air into and out of the oven chamber, means for supplying heated air to the first and second ducts for transmission thereof into the oven chamber through the openings of the associated duct, means including the first and second ducts and their associated openings for returning air from the oven chamber to the supply means, and control means in the supply means and the return means for alternating the supply of heated air through the first duct and the second duct into the oven chamber and alternating the return of air out of the oven chamber through the second duct and the first duct, respectively, thereby establishing a flow of heated air alternately in opposite directions across the oven chamber between the first and second ducts. In a preferred form hereof, the control means includes at least one damper in each of the supply means and the return means and movable between open and closed positions, and means for moving the dampers between the open and closed positions.

In another preferred embodiment of the present invention, there is provided a reversible cross flow drying or curing oven comprising an oven housing having opposed side walls defining a drying or curing chamber therebetween for receiving articles to be dried or cured, first and second ducts disposed along the respective opposite side walls of the housing and having openings for transmitting air into and out of the chamber, means for supplying heated air to the first and second ducts including first and second supply ducts, respectively, and a heater, means for returning air from the first duct and the second duct to the supply means including first and second return ducts, respectively, a damper in each of the first and second supply ducts and the first and second return ducts movable between a position substantially closing the associated duct from air flow and a position opening the duct to air flow, and means connected to each damper for moving the damper between its duct closed and its duct open positions, whereby opening the dampers in the first supply duct and the second return duct and closing the dampers in the second supply duct and the first return duct enables convection air flow in one direction from the first duct through the chamber into the second duct, and subsequently closing the dampers in the first supply duct and the second return duct and opening the dampers in the second supply duct and the first return duct enables convection air flow in the opposite direction from the second duct through the chamber into the first duct.

The accompanying drawings, which are incorporated in and constitute a part of this specification, illustrate a preferred embodiment of the present invention and, together with the description, serves to explain the principles of the invention.

DESCRIPTION OF A PREFERRED EMBODIMENT

Figure 1:
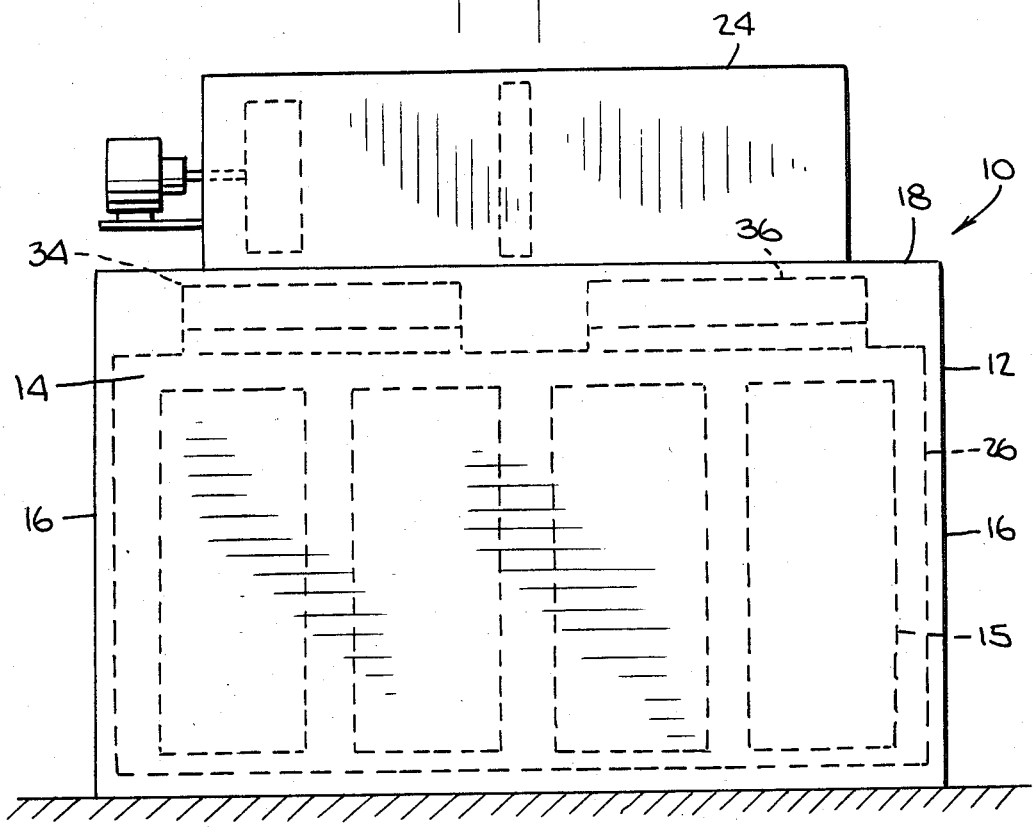
FIG. 1 is a side elevational view of a reversible cross flow drying or curing oven constructed in accordance with the present invention and illustrating a portion of the heated air circulating system therefor.
Figure 2:
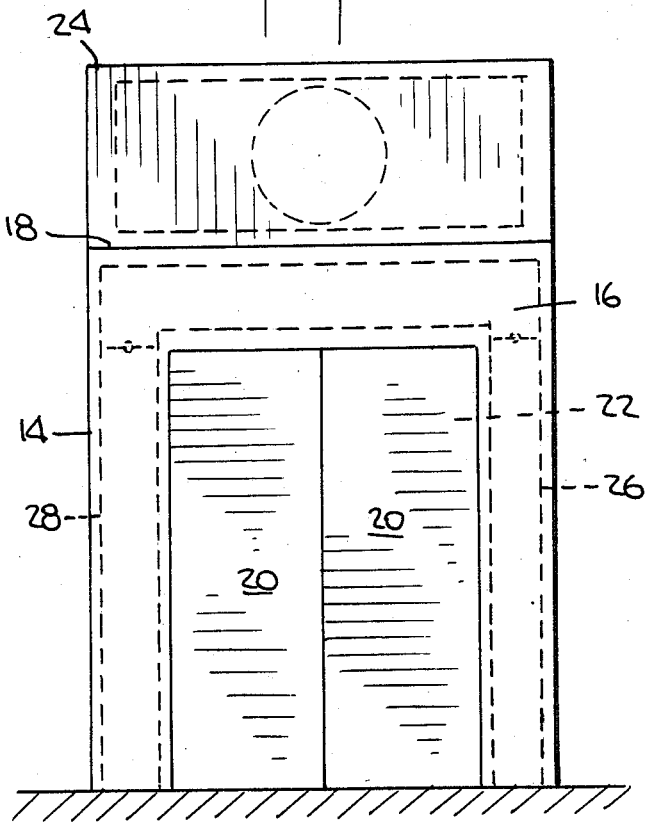
FIG. 2 is an end elevational view thereof also illustrating a portion of the heated air circulating system.
Figure 3:
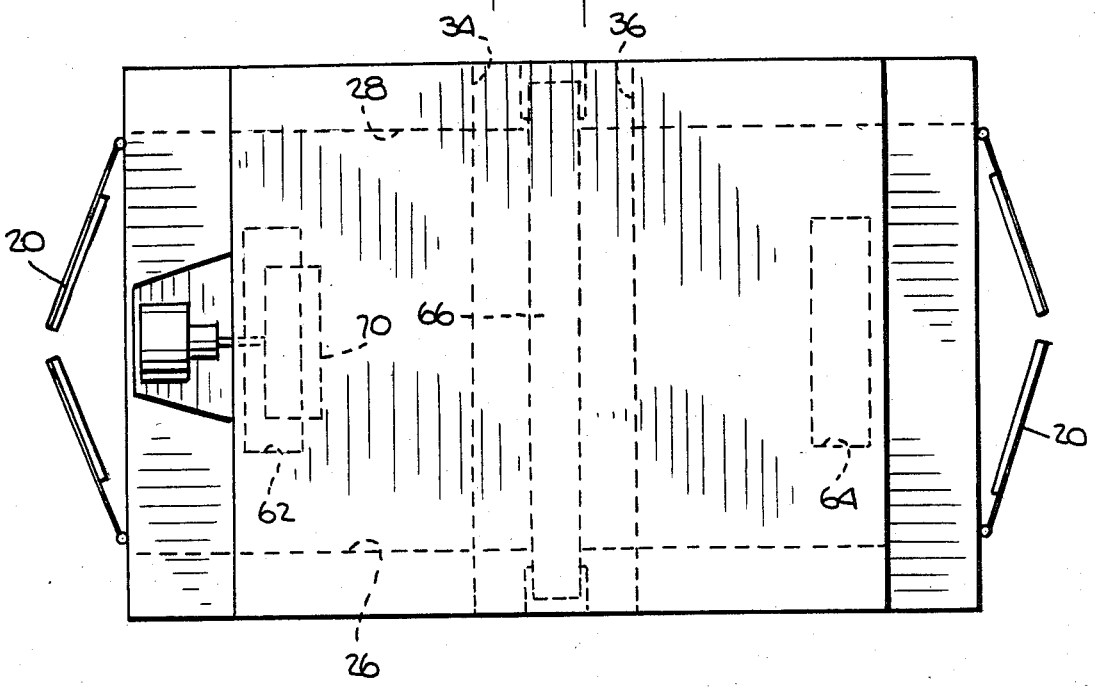
FIG. 3 is a plan view thereof likewise illustrating a portion of the heated air circulating system.

Referring now to the drawings, particularly to FIGS. 1 and 2, there is illustrated a reversible cross flow drying or curing oven constructed in accordance with the present invention and generally designated 10. Oven 10 includes a generally box-like housing 12 having side walls 14, and end walls 16, and a top wall 18. Doors 20 are hingedly mounted on each of the opposite end walls 16 and open outwardly to provide access to the interior of oven 10 from opposite ends thereof. Articles for drying or curing, such as workpieces, may be carried on racks, schematically illustrated at 15, mounted on rollers whereby the articles may be rolled through open doors 20 at one end of oven 10 into the ovens heat chamber, generally designated 22, defined between side and end walls 14 and 16, respectively, and below top wall 18. Accordingly, dried or cured articles may be rolled from heat chamber 22 through doors 20 at the opposite ends of the oven. Thus, oven 10 is useful for drying or curing articles in a continuous batch type process. On top of oven housing 12 is a cupola 24 housing mechanicals and ductwork described hereinafter.

The interior of oven 10 is provided with an air circulating system comprised of ductwork including first and second elongated, generally horizontally extending, ducts 26 and 28, respectively, disposed along the respective opposite side walls 14 of housing 12. Ducts 26 and 28 are spaced laterally one from the other and further define therebetween the heat chamber 22. Each duct 26 and 28 includes a plurality of openings or apertures 30 longitudinally spaced one from the other along its inwardly facing wall for flowing air into or out of heat chamber 22 in a manner described hereinafter. Each opening 30 is provided with adjustable louvers 32 which control the rate of flow of heated air into and out of oven chamber 22 as well as its direction when flowing into chamber 22. Louvers 32 may be manually adjusted for each drying or curing operation in accordance with the characteristics of the articles to be dried or cured.

Cross over supply and return ducts 34 and 36, respectively, are provided. Particularly, supply duct 34 includes a main supply passage 38 and a pair of downwardly directed, supply passageways 40 and 42 in communication at their upper ends with the respective opposite ends of main supply passage 38. Supply passageways 40 and 42 communicate at their lower ends, with first and second side ducts 26 and 28, respectively. Communication between supply passageways 40 and 42 and ducts 26 and 28 is controlled by suitable flow control devices, such as dampers 44 and 46, respectively. Thus, flow of air through main supply passage 38 may be directed to one or the other of side ducts 26 and 28 through its corresponding passageways 40 or 42 by operating supply dampers 44 and 46 to close or open the passages therebetween. That is, by closing damper 46 and opening damper 44, flow of air may be directed from main supply passage 38 through passageway 40 into side duct 26 and into oven chamber 22 through openings 30 in side duct 26. conversely, by closing damper 44 and opening damper 46, flow of air may be directed from main supply passage 38 through passageway 42 into side duct 28 and into oven chamber 22 through openings 30 in side duct 28.

Return duct 36 includes a main return passage 48 and a pair of downwardly directed passageways 50 and 52 in communication at their upper ends with the respective opposite ends of main return passage 48. Return passageways 50 and 52 communicate, at their lower ends, with first and second ducts 26 and 28, respectively. Communication between return passageways 50 and 52 and ducts 26 and 28 is similarly controlled by suitable flow control devices, such as damper 54 and 56, respectively. Thus, flow of return air from one or the other of ducts 26 and 28 may be directed to main return passage 36 through the associated return passageway 50 or 52 by opening the corresponding dampers 54 or 56. Similarly, return flow of air from one or the other of side ducts 26 and 28 may be blocked from returning to main return passage 36 by closing the associated damper 54 or 56. That is, by closing damper 54 and opening damper 56, return air may flow from duct 28 through return passageway 52 into main return passage 36. Conversely, by closing damper 56 and opening damper 54, return air may flow from duct 26 through return passageway 50 into main return passage 36.

Figure 5:
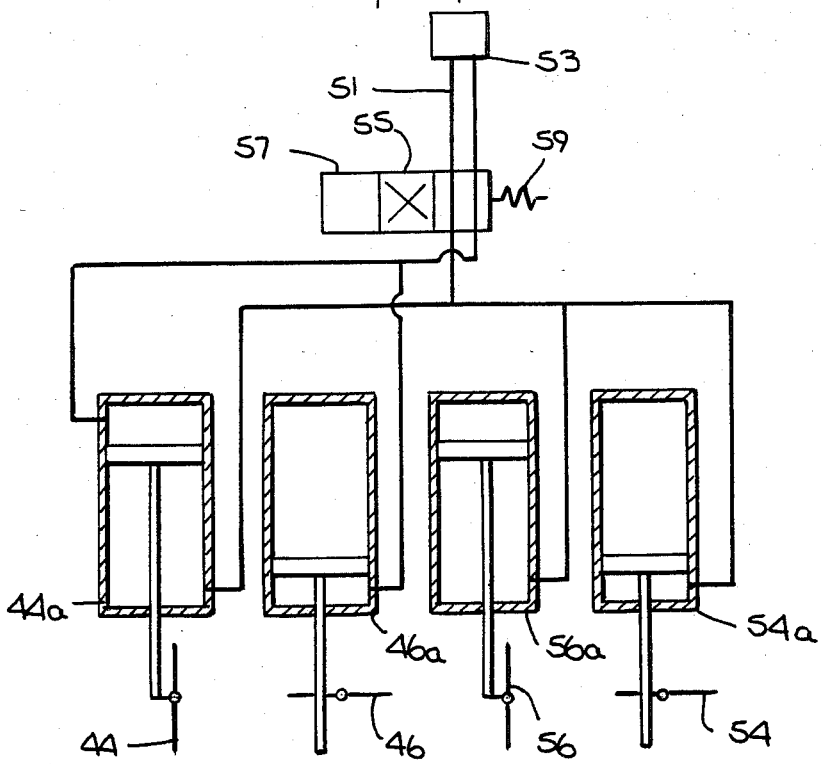
FIG. 5 is a schematic illustration of a pneumatic circuit for operating the flow control devices used in the air circulating system of the drying or curing oven hereof.

Referring now to FIG. 5, there is illustrated a pneumatic control circuit for operating dampers 44, 46, 54, and 56. Particularly, each damper is controlled by an associated air cylinder 44*a*, 46*a*, 54*a*, and 56*a*. A supply line 51 provides air under pressure from a supply source 53 through a four way, two position, solenoid actuated, spring returned valve 55, the solenoid and spring being designated 57 and 59, respectively. Thus, in the illustrated position of valve 55, air is supplied cylinders 44*a* and 56*a* to retract the associated pistons and consequently rotate, through an appropriate linkage, not shown, dampers 44 and 56 to their illustrated open positions. Similarly, air supplied cylinders 46*a* and 54*a* extends the associated pistons and consequently rotates, through an appropriate linkage, not shown, dampers 46 and 54 to their illustrated closed positions. By energizing solenoid 57, valve 55 is shifted. Thus, in the shifted position of valve 55, air is supplied cylinders 46*a* and 4*a* to retract the associated pistons and close dampers 46 and 54. Simultaneously, air is supplied cylinders 44*a* and 56*a* to extend their associated pistons and open dampers 44 and 56. Thus, the dampers operate in pairs; i.e., a supply and a return damper, each on opposite sides of the oven chamber from the other, are always open or closed, while the other pair of the supply and return dampers on opposite sides of the oven chamber are always closed or open, respectively.

Figure 4:
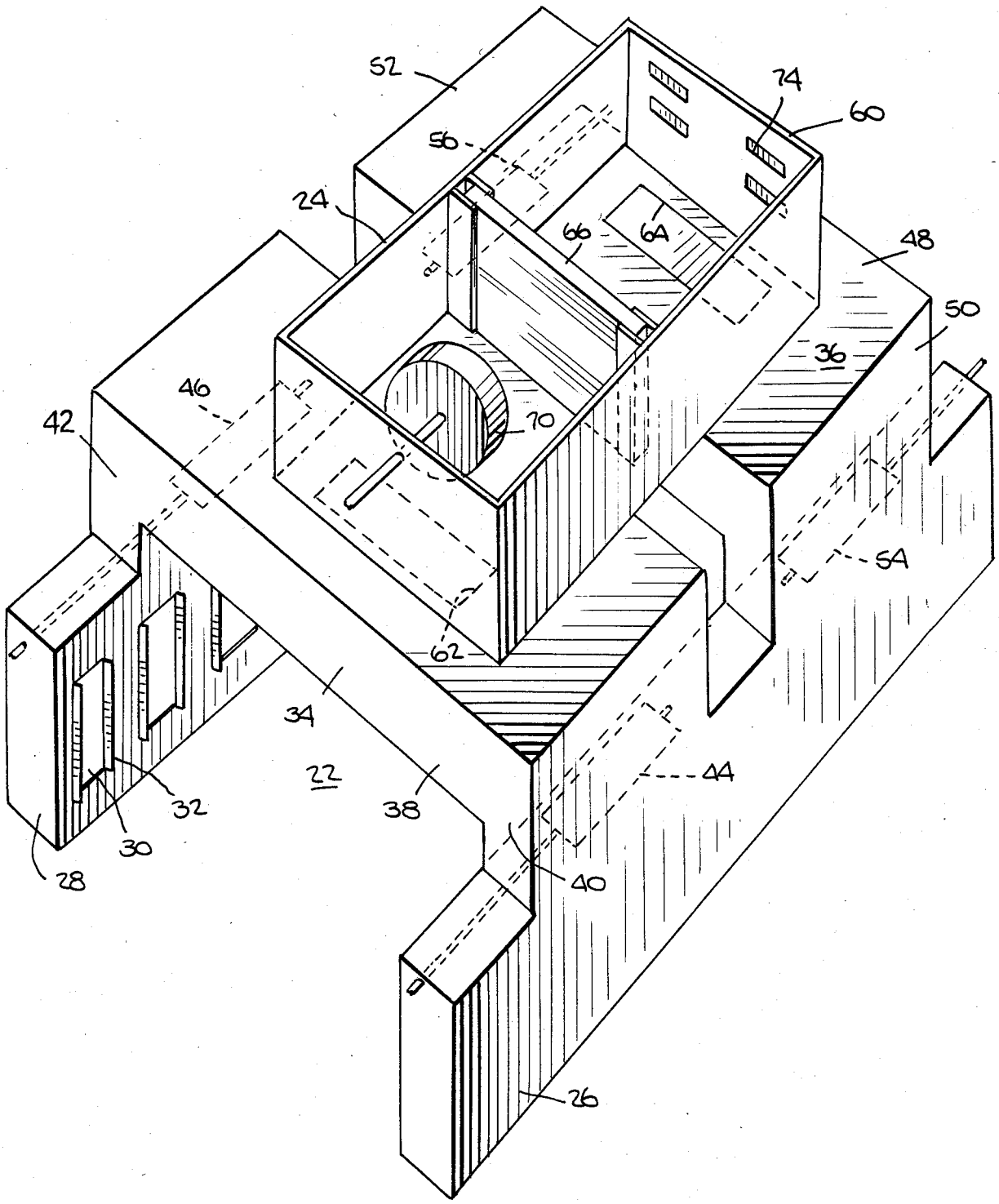
FIG. 4 is a schematic perspective view of a portion of the heated air circulating of the oven hereof with the top of the oven cupola broken out and particularly illustrating the locations of flow control devices for establishing the flow patterns of heated through the oven chamber.

Referring back to FIG. 4, cupola 24 comprises a generally box-like housing 60 secured above both cross over main supply and return passages 34 and 36, respectively. Openings 62 and 64 are provided through the tops of ducts 34 and 36, respectively. Thus, communication is provided between the interior of cupola 24 at one end thereof with supply duct 34 through opening 62 and at its opposite end with return duct 36 through opening 64. Disposed between openings 62 and 64 and within cupola housing 60 is a heater 66. Heater 66 may comprise any conventional heating element, such as a steam heating coil with suitable external connections to a source of steam, or an electric heating coil suitably connected to a source of electric current. Preferably, heater 66 is removably mounted within cupola housing 66 by means of an access door, not shown, in the side of housing 60. Forward of heater 66 is a recirculating fan 70 driven by a motor 72 mounted externally of cupola housing 60. At the rear end of cupola housing 60 are a series of adjustable openings 74 in the housing end wall. Openings 74 permit the fan to drawing atmospheric air into the air circulating system, as needed to make up for hot air loss during the operation of the oven, which will now be described.

In use, the articles to be dried or cured are loaded on racks and disposed within the oven chamber 22 through the open doors 20 at one end of oven housing 12. With doors 20 closed and the adjustable louvers 32 set as desired for the particular drying or curing operation, heater 66 and fan 70 are energized. In keeping with the principles of the present invention, heated air is provided in oven chamber 22 in an alternating cross air flow pattern. That is, heated air is directed to flow from one side duct; e.g., duct 26, toward the other side duct; e.g., duct 28, for a predetermined time period. At the expiration of this predetermined time period, the heated air is directed to flow from the other side duct; e.g., duct 28, toward the one side duct; e.g., duct 26. The direction of the cross over air flow pattern is thus reversed within oven chamber 22 at periodic intervals. Consequently, temperature gradients resulting from heated air flow in one direction across chamber 22 are evened out by the heated air flow across oven chamber 22 in the opposite direction resulting in application of heat to articles undergoing the drying or curing process at a substantially more constant temperature and more uniformly throughout oven chamber 22. This enables substantially even drying or curing of the articles regardless of their orientation and location within the oven chamber 22 and minimizes or eliminates the danger of cracking, warping or otherwise distorting the articles.

To accomplish this periodic reversal of heated air flow patterns within oven chamber 22, air is supplied through valve 55 as illustrated in FIG. 5 to cylinders 44*a* and 56*a* to open the corresponding dampers 44 and 56 enabling communication between main supply passage 34 and duct 26 on the supply side and communication between main return 36 and duct 28 on the return side. Also, air is supplied through valve 55 to cylinders 46*a* and 54*a* to close the corresponding damper 46 and 54 preventing communication between main supply passage 34 and duct 28 on the supply side and communication between main return 36 and duct 26 on the return side. Consequently, heated air is suctioned by fan 70 in cupola 24 through heater 66 and directed through opening 62 into main supply passage 34. From there, the heated air flows through supply passageway 40 into duct 26 and outwardly thereof through openings 30 in duct 26 into oven chamber 22. The air thus crosses in chamber 22 from duct 26 to duct 28 and enters the latter through the openings 30 in its side wall. From there, this return air flows past open damper 56 into return passageway 52 and main return passage 36 and through opening 64 into cupola 24. With this air flow pattern, the closed dampers 46 and 54 prevent reverse flow of supply air through supply passageway 42 into duct 28 and reverse flow of return air through return passageway 50. Thus, a cross flow of heated air from duct 26 across the oven chamber 22 to duct 28 is established and continues for a predetermined time interval. At the end of this time interval, the direction of the flow across the chamber is reversed.

To reverse the flow, cylinders 46*a* and 54*a* are actuated by shifting valve 55 to its other position thereby closing dampers 46 and 54. With the fan and heater running continuously, heated air is thus supplied oven chamber 22 by flow through opening 62 into main supply passage 34 and supply passageway 42, and past the open damper 46 into duct 28 for outflow through openings 30 into oven chamber 22. The air in oven chamber 22 is returned by flowing through openings 30 into duct 26, into main return passage 36 via open damper 54 and return passageway 50 and through opening 64 into cupola 24. Thus, a cross flow of heated air from duct 28 across oven chamber 22 to duct 26 is established. It will be appreciated that this latter flow across oven chamber 22 is in the reverse direction from the previously described cross flow and that these cross flows are alternated at periodic intervals; e.g., every five minutes or every few hours or days, depending upon the drying or curing characteristics desired. With each cross flow, it will also be appreciated that air is made up by atmospheric air entering cupola 24 through openings 74 and thus a constant supply of heated air is provided.

As illustrated, the cylinders controlling the dampers are under the control of a single two position, solenoid actuated, spring returned valve 55. Actuation of the solenoid may be accomplished manually or automatically. For example, the solenoid may be coupled to an electrical circuit having a current supply and a manually actuated switch with a releasable mechanical hold. Thus, closing the switch, and mechanically holding the switch closed, will cause a supply damper and a return damper on opposite sides of the oven to open while maintaining the other of the supply damper and the return damper on opposite sides of the oven to close. This establishes a heated air flow pattern across chamber 22 in one direction. After a predetermined time interval, the switch is manually opened to permit the valve to spring return it its other position. This reverses the motion of the pistons of the cylinders causing the previously open dampers to close and the previously closed dampers to open establishing a heated air flow pattern across oven chamber 22 in the reverse direction. It will also be appreciated that reversing the heated air flow pattern may be accomplished automatically by actuating the solenoid of valve 55 by means of a timer. Thus, automatic reversal of the heated air flow pattern across oven chamber 22 at desired periodic intervals depending upon the drying or curing characterstics of the articles may be obtained.

It will be apparent to those skilled in the art that various modifications and variations can be made in the reversible cross flow drying or curing oven hereof without departing from the scope or spirit of the present invention.

What is claimed is:

1. A reversible cross flow drying or curing oven comprising:

an oven housing having opposed side walls defining a drying or curing chamber therebetween for receiving articles to be dried or cured, first and second ducts disposed along the respective opposite side walls of said housing and having openings for supplying air into and receiving air from said oven chamber, a crossover air supply duct within said oven overlying the curing chamber and connected by supply passageways at opposite ends to said first and second ducts for supplying air thereto, damper means located between the supply passageways and the first and second ducts, a crossover air return duct within said oven adjacent the air supply duct overlying the curing chamber and connected by return passageways at opposite ends to said first and second ducts for receiving air therefrom, a damper means located between the return passageways and the first and second ducts, a cupola housing overlying the air supply and air return ducts, said cupola defining a chamber for receiving return air from the return duct, having means for conditioning the return air, and means for recirculating the air to the air supply duct for return to the curing chamber, and means for periodically opening and closing an air supply damper and an air return damper to periodically reverse the flow of air across said oven chamber.

2. An oven according to claim 1 wherein said recirculating means includes a fan in the cupola housing for forcing heated air through said ducts the fan being disposed to force air unidirectionally through the cupola housing, the first and second supply ducts and said first and second return ducts.

3. An oven according to claim 1 wherein the cupola housing includes an opening to atmosphere for drawing make-up air into the cupola housing.

4. An oven according to claim 1 wherein the first and second duct openings are adjustable for controlling the rate and direction of the air flow therethrough.

* * * * *